United States Patent [19]

Combs

[11] Patent Number: 4,846,752

[45] Date of Patent: Jul. 11, 1989

[54] REMOTE CONTROLLED ROLLER SKATING TOY

[76] Inventor: Williams M. Combs, PSC #2, Box 3545, Hickam, AFB, Hi. 96853

[21] Appl. No.: 170,010

[22] Filed: Mar. 18, 1988

[51] Int. Cl.[4] ..... A63H 13/00; A63H 11/00; A63H 30/04

[52] U.S. Cl. ..... 446/279; 446/353; 446/456

[58] Field of Search ..... 446/279, 272, 280, 286, 446/258, 289, 290, 293, 352, 353, 354, 456

[56] References Cited

U.S. PATENT DOCUMENTS

| | | | |
|---|---|---|---|
| 210,480 | 12/1878 | Adams | 446/280 |
| 1,880,138 | 9/1932 | Hübl | 446/290 X |
| 3,178,853 | 4/1965 | Greenwood et al. | 446/356 X |
| 3,199,249 | 8/1965 | Carver | 446/290 |
| 3,484,988 | 12/1969 | Robbins | 446/355 |
| 3,514,896 | 6/1970 | Neufeld | 446/290 |
| 3,574,969 | 4/1971 | Cleveland | 446/275 |
| 3,650,065 | 3/1972 | Johmann | 446/354 |
| 3,703,048 | 11/1972 | Cooper | 446/336 |
| 3,834,071 | 9/1974 | Terzian et al. | 446/353 |
| 4,166,338 | 9/1979 | Asano | 446/456 |
| 4,186,516 | 2/1980 | Ensmann | 446/238 |
| 4,213,269 | 7/1980 | Grogg, Sr. | 446/433 |
| 4,263,741 | 4/1981 | Koshiya | 446/293 X |
| 4,355,482 | 10/1982 | Sapkus et al. | 446/279 |
| 4,422,261 | 12/1983 | Kozuka | 446/290 |
| 4,454,679 | 6/1984 | Ogawa | 446/290 |
| 4,708,688 | 11/1987 | Lee | 446/290 X |

FOREIGN PATENT DOCUMENTS

| | | | |
|---|---|---|---|
| 1344435 | 10/1963 | France | 446/354 |
| 2027349 | 2/1980 | United Kingdom | 446/279 |
| 2156694 | 10/1985 | United Kingdom | 446/353 |

*Primary Examiner*—Robert A. Hafer
*Assistant Examiner*—D. Neal Muir
*Attorney, Agent, or Firm*—Leon Gilden

[57] ABSTRACT

A remote controlled rolling skating toy is set forth wherein a female figure has formed internally thereof a plurality of batteries for supplying power to a remote control signal receiving device to selectively actuate a plurality of motors positioned in the torso portion of the figure for appropriate and desired weight distribution thereof and wherein a plurality of driven roller chains are positioned through either leg of the figure cooperating with a plurality of tension rollers to drive each of a plurality of roller skates integrally secured to each foot of the associated figure.

1 Claim, 5 Drawing Sheets

REMOTE CONTROLLED ROLLER SKATING TOY

BACKGROUND OF THE INVENTION

1. Field of the Invention

The field of invention relates to toys, and more particularly pertains to an improved remote controlled roller skating figure including a self-contained power pack for providing power to drive associated skate wheels of the figure.

2. Description of the Prior Art

Toys of various mobilities and configurations are well known in the prior art. As may be appreciated, these devices are directed towards children for their amusement and education to the varying laws of motion and those associated with the physical properties of movement. For example, U.S. Pat. No. 210,480 to Adams sets forth a doll-like figure secured within a carriage structure wherein the figure secured from the carriage is suspended therefrom whereby rotation of an associated carriage axle are transmitted to effect rising and falling or jumping motions of the figure. The Adams patent sets forth an early toy-like structure for amusement purposes.

U.S. Pat. No. 3,199,249 to Carver, et al., sets forth a robot-like toy and mechanism wherein the toy may pivot at the waist with a motor of limited power to provide such bending with associated linkages and drives to effect this desired activity wherein furthermore the Carver patent positions a toy on a carriage structure whereby an associated remote control unit is connected to the toy to effect the various motions. While an interesting toy of relative structural complexity, the Carver patent is of an organization and function relatively remote from that of the instant invention.

U.S. Pat. No. 3,514,896 to Neufeld sets forth a toy animal provided with a pivotal joint proximate one end of the scalable structure of the animal to enable pivoting of the toy at that point including wheels attached to the extremities of the animal to enable mobility of the toy organization. The patent is of interest only relative to the notion of providing a wheeled quadruped and is of an organization distinct structurally and functionally from that of the instant invention.

U.S. Pat. No. 3,574,969 to Cleveland sets forth a doll-like structure securable to a scooter to selectively provide mobility to the noted doll figure. The Cleveland patent is of interest to note the provision of a wheeled doll-like figure.

U.S. Pat. No. 3,703,048 to Cooper sets forth a toy robot wherein the robot simulates a karate chop with a first arm when a second arm is moved slightly. The robot structure is provided with a wheeled support platform that is motorized to enable and effect mobility of the toy.

U.S. Pat. No. 4,186,516 to Ensmann sets forth a toy doll securable to a mobile platform that enables the doll to simulate skating movements with a plurality of legs pivotally secured to a torso to enable one of the legs to rotate in an unrestrained manner with respect to the other leg for such skating simulation. The doll of Ensmann is of interest only to the general notion of a skating figure and is of relatively unrelated structure to the instant invention.

U.S. Pat. No. 4,422,261 to Kozuka provides a snow skating figure capable of pivotal motion on a support surface with an included motor to enable independent movement of the toy with respect to a user wherein the motor is provided with a plurality of drive wheels to effect such motion.

U.S. Pat. No. 4,454,679 to Ogawa wherein a figure is provided with a plural pair of wheels wherein a first pair is secured proximate a foot portion of the figure that in cooperation with torso mounted wheels enables locomotion of the toy upon a support surface. The toy is provided with motor means to effect such motion and is of interest only as another example of a toy figure provided with wheels for locomotion thereof.

In contrast thereto, the instant invention provides a roller skating figure with a chain driven plurality of wheels to enable the simulation of a roller skating figure that addresses both the issues of compactness, portability, and realism associated with a toy for the emotional enhancement of children in play.

SUMMARY OF THE INVENTION

In view of the foregoing disadvantages inherent in the known types of toy figures provided with motorized wheels now present in the prior art, the present invention provides an remote controlled roller skating toy which by means of internally included and weight distributed components enables the associated figure to realistically portray a roller skating figure when in use for the enhancement of children's imagination. As such, the general purpose of the present invention, which will be described subsequently in greater detail, is to provide a new and improved remote controlled roller skating toy which has all the advantages of the prior art remote controlled motorized toys and none of the disadvantages.

To attain this, the present invention comprises a roller skating figure which is formed with internal weight distributed components to simulate weight proportioning of a roller skating individual provided with a plurality of selectively operative and energizable motors from a remote controlled source wherein one of a plurality of drive chains associated with each motor extends through each leg of the figure to actuate driven wheels of a roller skating assembly secured to the feet-like structure of the toy.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved remote controlled roller skating toy which has all the advantages of the prior art remote controlled roller skating toys and none of the disadvantages.

It is another object of the present invention to provide a new and improved remote controlled roller skating toy which may be easily and efficiently manufactured and marketed.

It is a further object of the present invention to provide a new and improved remote controlled roller skating toy which is of a durable and reliable construction.

An even further object of the present invention is to provide a new and improved remote controlled roller skating toy which is susceptible of a low cost of manufacture with regard to both materials and labor, and which accordingly is then susceptible of low prices of sale to the consuming public, thereby making such remote controlled roller skating toys economically available to the buying public.

Still yet another object of the present invention is to provide a new and improved remote controlled roller skating toy which provides in the apparatuses and methods of the prior art some of the advantages thereof, while simultaneously overcoming some of the disadvantages normally associated therewith.

Still another object of the present invention is to provide a new and improved remote controlled roller skating toy wherein positioning of a plurality of motors with an associated battery pack and receiver mechanism is operative through a plurality of driven chains to actuate one of a pair of roller skating wheels associated with each foot of the roller skating figure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
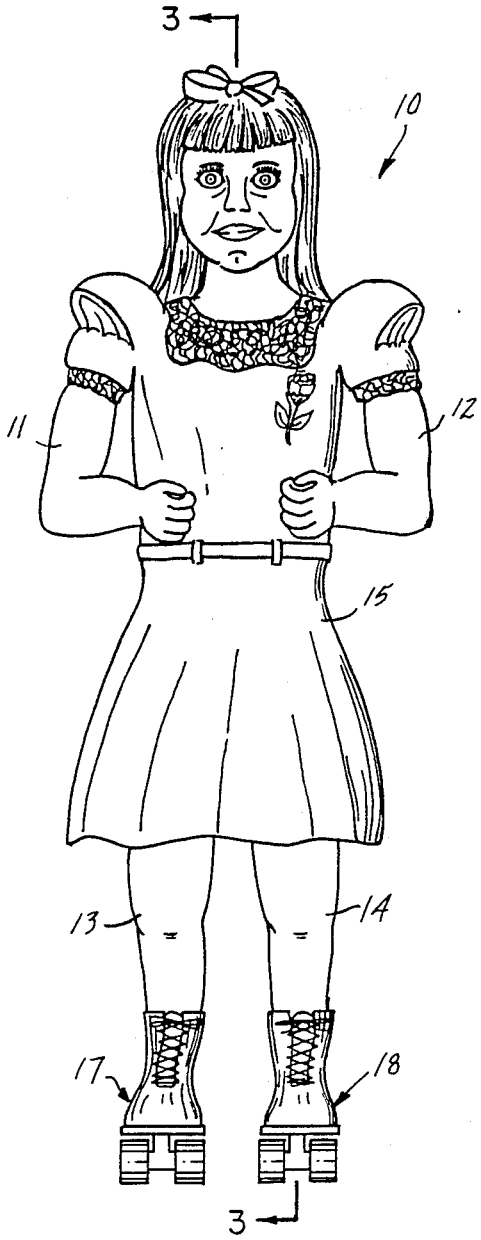
FIG. 1 is a frontal orthographic view of the instant invention taken in elevation.

With reference now to the drawings, and in particular to FIGS. 1 to 11 thereof, a new and improved remote controlled roller skating toy embodying the principles and concepts of the present invention and generally designated by the reference numeral 10 will be described.

Figure 2:
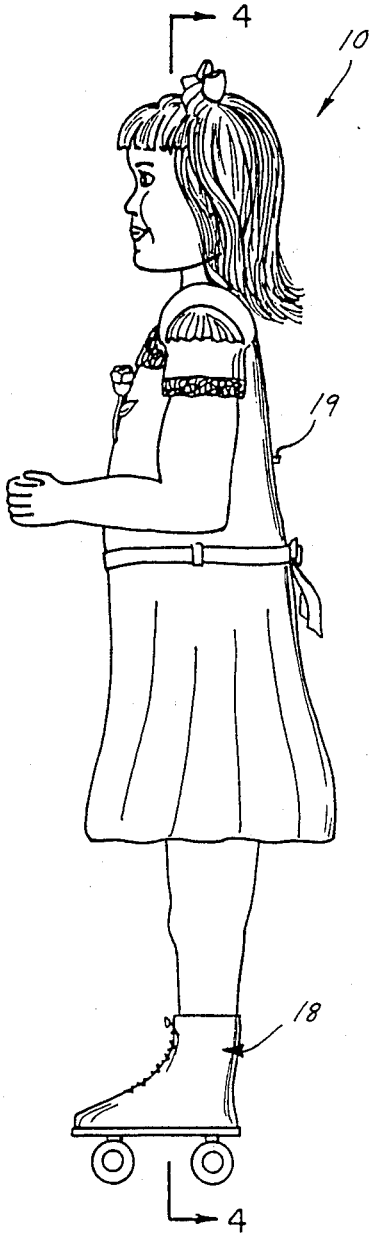
FIG. 2 is a side orthographic view of the instant invention taken in elevation.
Figure 3:
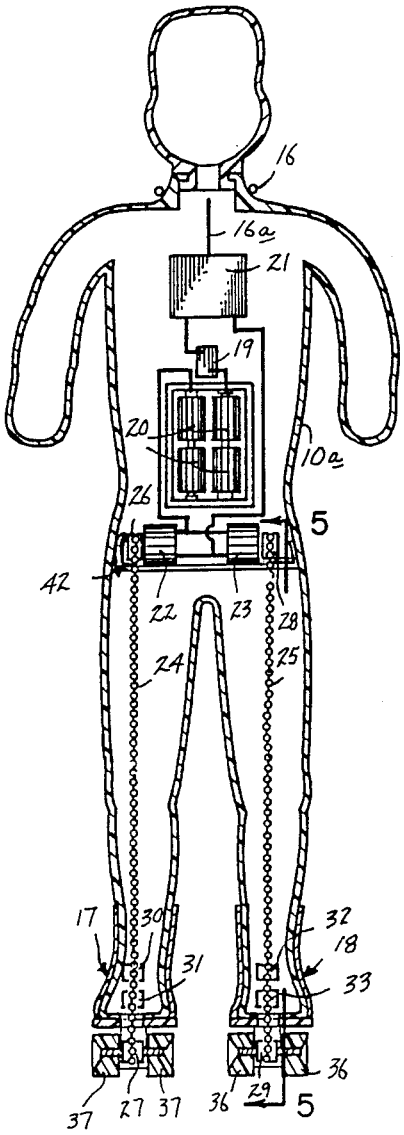
FIG. 3 is an orthographic sectional view taken along the lines 3—3 of FIG. 1 in the direction indicated by the arrows.
Figure 4:
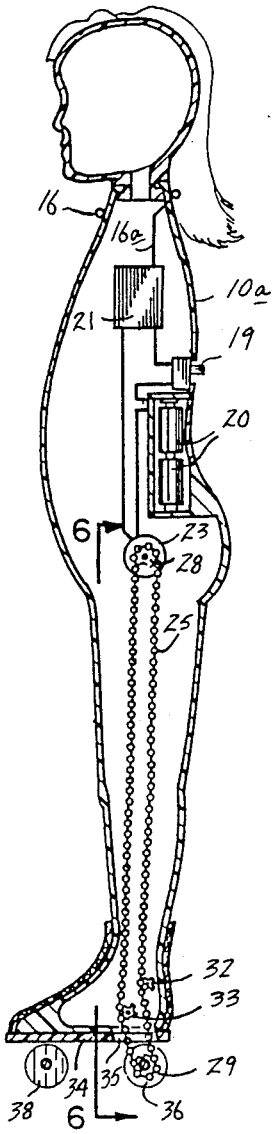
FIG. 4 is an orthographic sectional view taken along the lines 4—4 of FIG. 2 in the direction indicated by the arrows.

More specifically, it will be noted that the remote controlled roller skating toy 10 essentially comprises a figure of a roller skating girl including a respective right and left arms 11 and 12 and associated right and left legs 13 and 14 conventionally attired in a skirt arrangement 15 typical of this age group and fashion of female attire with a necklace 16 in conformity with the fashion attire of the girl figure that is in essence an antennae for an internally positioned remote controlled receiving device illustrated in FIGS. 3 and 4, for example. Secured to the respective right and left legs of the roller skating figure are respective right and left roller skating shoe 17 and 18 formed with conventional forward and rear pairs of roller skating wheels to be subsequently described in greater detail. An on/off switch emanating rearwardly of the figure's back portion, as illustrated in FIG. 2, provides the only clue to the mechanized character of the remote controlled roller skating toy of the instant invention. The toy is essentially formed of a plastic-like material and, as illustrated in FIGS. 3 and 4, the torso **10*a* of the toy 10 houses a plurality of the components to proportion the weight distribution of the components throughout the torso of the roller skating toy 10 to orient the center of gravity of the toy within the torso portion 10*a* of the roller skating toy 10 to simulate human weight distribution and accordingly present an elemenet of challenge to a child utilizing the roller skating toy 10** in play.

A necklace 10 oriented about the neck of the toy 10 provides the antennae cooperating with an antennae extension **16*a*, as illustrated in FIGS. 3 and 4, directed into the remote control receiver unit 21. In underlying orientation to the figure of the roller skating toy 10 are a respective right and left roller skating shoe 17 and 18** having secured thereto plural pairs of respective drive and driven wheels to motivate the toy about a support surface.

As illustrated in FIGS. 3 and 4, a plurality of batteries 20 forming a battery pack to provide energy to motivate the respective right and left electric drive motors 22 and 23 are positioned somewhat medially and in aligned relationship to the rear driven wheels illustrated as right driven wheels 37 and left driven wheels 36 in FIG. 3.

The respective right and left electric drive motors 22 and 23 have rotatably secured, respective right and left drive sprockets 26 and 28 respectively that engage a respective right and left drive ball chain 24 and 25, each extending through a lower limb of the roller skating toy 10 in cooperative engagement with respective right and left driven sprockets 27 and 28. Proper tension is provided to the respective drive ball chains 24 and 25 by plural pairs of tension sprockets illustrated as a right outer tension sprocket 30 cooperating with a right inner tension sprocket 31 to provide proper and predetermined tension to the right drive ball chain 24 with a left outer tension sprocket 32 cooperating with a left inner tension sprocket 33 to provide predetermined desired tension to the left drive ball chain 25.

Figure 5:
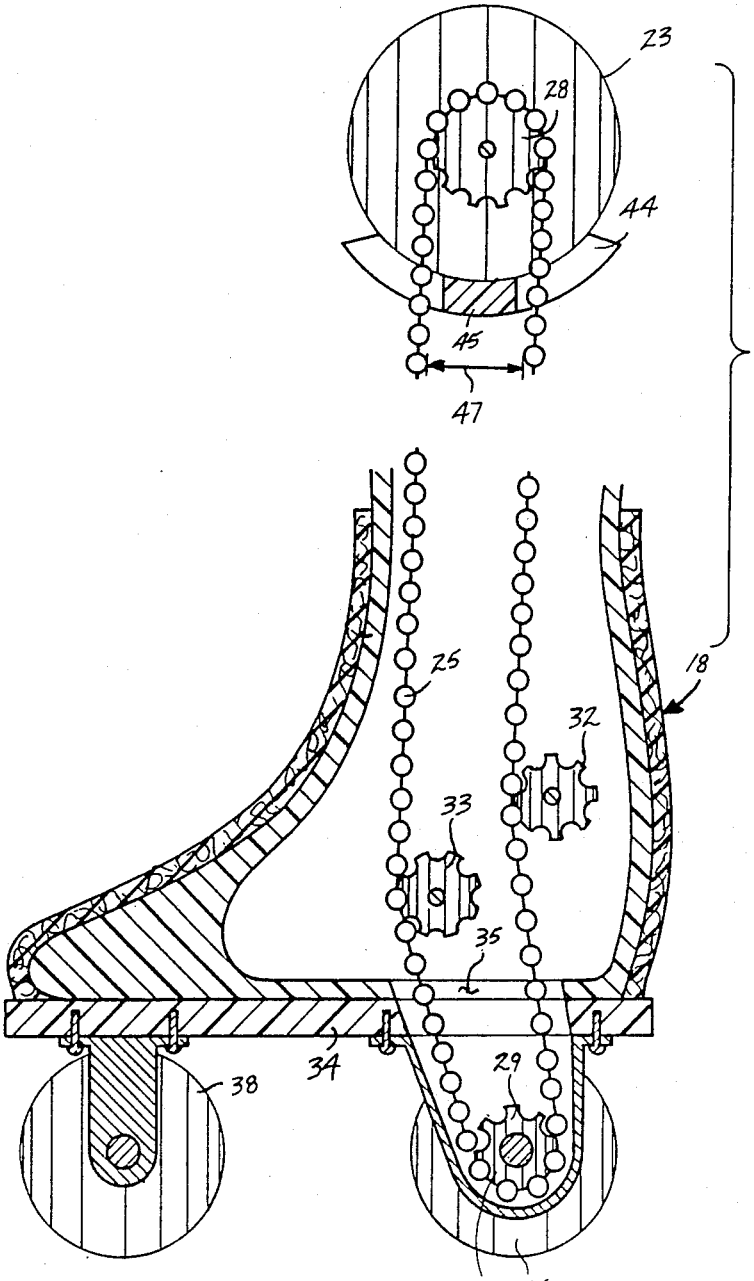
FIG. 5 is an orthographic sectional view taken along the lines 5—5 of FIG. 3 in the direction indicated by the arrows.

The respective drive ball chains 24 and 25 extend through the lower roller skating shoe bottoms 34 of the respective right and left roller skating shoes 17 and 18 through openings 35, as illustrated in FIGS. 4 and 5.

The respective right and left drive ball chains 24 and 25 proceed as described through openings 35 and engage respective right driven wheels 37 and left driven wheels 36 respectively, as illustrated in FIGS. 3 through 6. The front pairs of skate wheels 38 are essentially the same and provide balance to the respective roller skating shoes 17 and 18.

The driven rear wheels 36 and 37 respectively are secured together by means of a like axle member 39 wherein the driven wheels are integrally secured to the respective axles 39 and held thereon by threaded fasteners for similar securement means.

The rear respective drive sprockets 26 and 27 respectively are integrally fastened to the aforenoted axles 39 and are secured within a bearing housing 40 formed with cage roller bearings 41 positioned within recesses in said housing to either side of the respective driven sprockets 27 and 29.

Figure 6:
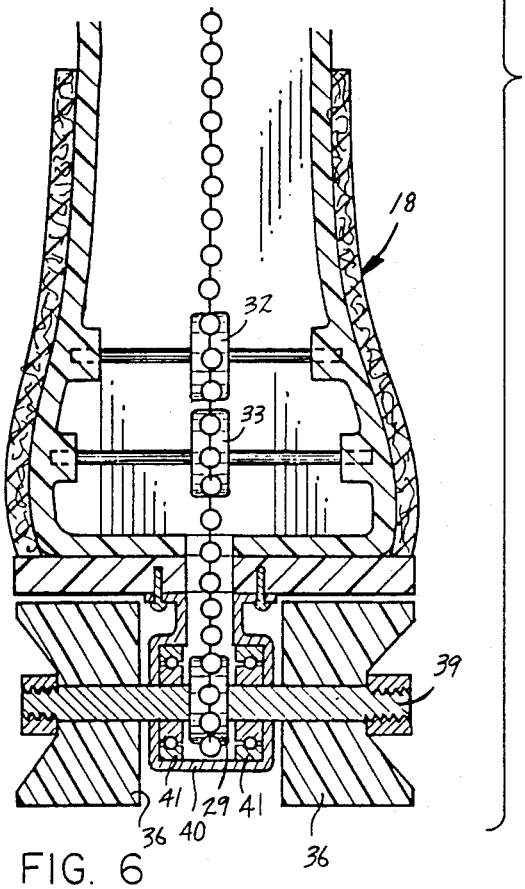
FIG. 6 is an orthographic sectional view taken along the lines 6—6 of FIG. 4 in the direction indicated by the arrows.
Figure 9:
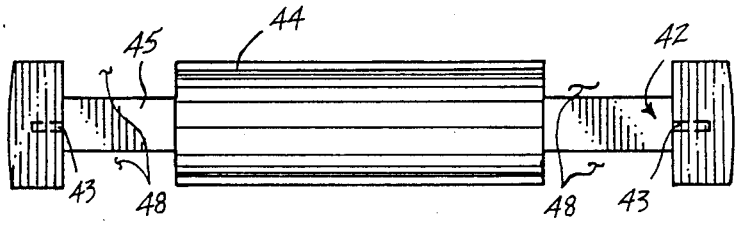
FIG. 9 is a top orthographic view of the motor support bracket of the instant invention.
Figure 10:
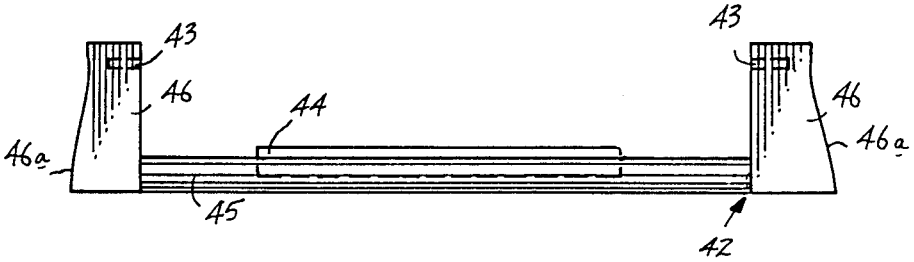
FIG. 10 is an orthographic view taken in elevation of the motor support bracket of the instant invention.
Figure 11:
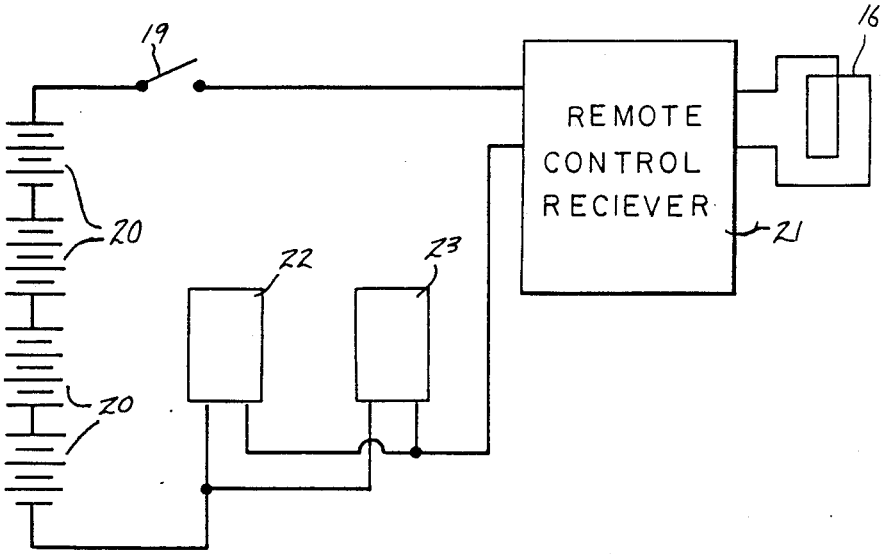
FIG. 11 is a schematic illustration of typical circuitry utilized by the instant invention.

Attention to FIGS. 9 and 10 illustrate the electric motor support bracket 42 formed with a cradle 44 wherein the right and left respective motors 22 and 23 are secured, as illustrated in FIGS. 1, 5, and 6. The respective output shafts, such as **23*a* illustrated in FIG. 6, is positioned and supported within an output recess 43 formed within an upstanding leg of the support bracket 42 wherein a support spine 45 extends between the upstanding legs 46. The exterior surfaces 46*a* of the upstanding legs 46 are of torso conforming configuration to provide figurational integrity to the torso wall 10*a*, as illustrated in FIG. 6. Furthermore, an "H" shaped opening 48 is formed between either end of cradle 44 and the upstanding legs 46, as illustrated in FIG. 9, to enable the ball chain span 47, as illustrated in FIG. 5, to depend to either side of the support spine 45 and is of a diameter comparable to that of the respective drive sprockets 26 and 28** respectively.

Figure 8:
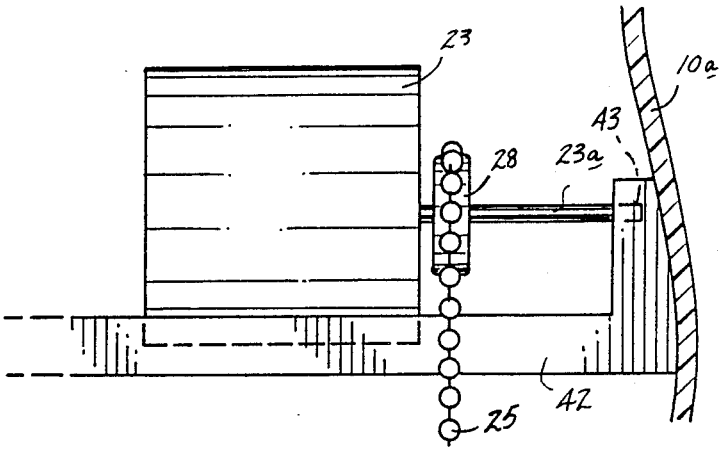
FIG. 8 is an orthographic view taken in elevation along the lines 8—8 of FIG. 7 in the direction indicated by the arrows.
Figure 8:
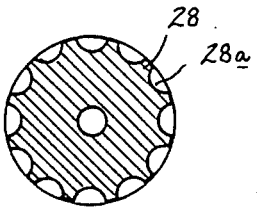
Figure 7:
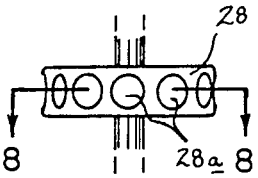
FIG. 7 is a top orthographic view of a typical sprocket wheel as utilized by the instant invention.

Attention to FIGS. 7 and 8 illustrate a typical drive sprocket 28 formed with spherical recesses **28*a* to conformingly accept companion drive chain 25 where similarly the drive sprocket 26 cooperates with spherical drive chain 24. Attention to FIG. 11 will note that upon switch 19 being closed, and antennae 16 receiving an appropriate signal received through the remote control receiver 21, the respective right and left electric motors 22 and 23 will be energized and powered by the plurality of included batteries 20. Accordingly the drive chains 24 and 25 will be actuated and drive the associated driven sprockets 27 and 29 to drive the associated axles 39 and integrally associated driven wheels 37** to motivate the remote controlled roller skating toy about a support surface.

As to the manner of usage and operation of the instant invention, the same should be apparent from the above description and accordingly no further discussion relative to the manner of usage and operation will set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A remote controlled roller skating toy comprising, a figure including a head, neck, torso, right and left arms, and right and left legs;

a roller skating shoe fitted on an end of each leg including a set of forward wheels and a set of rearward driven wheels on each shoe for traverse of a support surface, a remote controlled receiver means secured within said toy for receiving signals remote from said toy to complete a circuit to enable propulsion of said toy, a power supply within said toy, and motor means within said toy to accept power from said power supply to remotely drive said rear driven wheels, and a flexible power transmitting means mechanically associating said motor means and said rear driven wheels, and wherein said remote control receiver means, said power supply, and said motor means are positioned within the torso of said toy for desired weight distribution, and wherein said power supply comprises a plurality of batteries, and wherein said motor means comprises a plurality of motors wherein one motor is operably associated with one flexible power transmitting link within said power transmitting means for driving a set of said rear driven wheels on each of said roller skating shoes, and wherein each power transmitting link comprises an elongated endless chain operably secured to a drive sprocket on each of said motors and a driven sprocket on each of said driven wheels to supply power from said motor means to said rear driven wheels, and wherein an antennae is formed as a necklace about the neck of said figure to accept said signals and deliver them to said remote controlled receiver means, and wherein a plurality of tension sprockets including an inner and outer sprocket to provide desired tension to said drive chain are positioned within each leg of said figure, and wherein an opening in an underlying surface of said roller skating shoe enables passage of said drive chain from each driven sprocket to said drive sprocket in each leg of said figure, and wherein a general "U" shaped support bracket supports each motor in alignment in said bracket wherein said bracket is formed with a support spine spanning a distance between a plurality of upstanding legs with a wider arcuate cradle surface for supportingly securing said motors within said bracket wherein generally elongate openings are defined between said cradle and said upstanding legs to enable passage of said drive chain between said drive sprocket and said driven sprocket associated with each motor, and wherein each leg of said bracket is formed with an exterior curvilinear surface to provide support and complementary geometrical configuration within an interior surface of said torso.

* * * * *